US010553038B2

(12) United States Patent
De La Mora Molina et al.

(10) Patent No.: US 10,553,038 B2
(45) **Date of Patent: *Feb. 4, 2020**

(54) ANALYZING AND CLASSIFYING AUTOMOBILE SOUNDS

(71) Applicant: International Business Machines Corporation, Armonk, NY (US)

(72) Inventors: Laura Josefina De La Mora Molina, Jalisco (MX); Richard B. Finch, New Paltz, NY (US); Rogelio Fernando Gutierrez Valdes, Jalisco (MX); Claudia Isabel Sandoval Antunez, Jalisco (MX); Madeline Vega, Austin, TX (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 94 days.

This patent is subject to a terminal disclaimer.

(21) Appl. No.: 15/794,655

(22) Filed: Oct. 26, 2017

(65) Prior Publication Data

US 2018/0300963 A1 Oct. 18, 2018

Related U.S. Application Data

(63) Continuation of application No. 15/459,890, filed on Apr. 18, 2017.

(51) Int. Cl.

| | |
|---|---|
| ***G07C 5/00*** | (2006.01) |
| ***G07C 5/08*** | (2006.01) |
| ***G10L 25/51*** | (2013.01) |

(52) U.S. Cl.

CPC ..... *G07C 5/006* (2013.01); *G07C 5/0808* (2013.01); *G07C 5/0816* (2013.01); *G07C 5/0841* (2013.01); *G10L 25/51* (2013.01)

(58) Field of Classification Search

None

See application file for complete search history.

(56) References Cited

U.S. PATENT DOCUMENTS

| | | | |
|---|---|---|---|
| 5,598,141 | A | 1/1997 | Grasmann et al. |
| 2013/0188794 | A1 | 7/2013 | Kawamata et al. |

(Continued)

FOREIGN PATENT DOCUMENTS

| | | | |
|---|---|---|---|
| CA | 2883129 | A1 | 3/2014 |

OTHER PUBLICATIONS

List of IBM Patents or Patent Applications Treated as Related; (Appendix P), Filed Oct. 26, 2017, 2 pages.

(Continued)

*Primary Examiner* — Jelani A Smith
*Assistant Examiner* — Kelly D Williams
(74) *Attorney, Agent, or Firm* — Cantor Colburn LLP

(57) ABSTRACT

A computer-implemented method is provided for analyzing and classifying automobile sounds. The computer-implemented method includes causing a receiver to receive an audio input, determining whether the audio input is distinct from sounds stored in a library and breaking the audio input up into constituent segments in an event the audio input is distinct from sounds stored in the library. The computer-implemented method further includes determining whether any of the constituent segments are unassociated with known sources and determining whether present conditions, which were in effect during the receiving of the audio input, are similar to prior conditions, which were in effect during a previous audio input reception, in an event constituent segments are unassociated with the known sources. In addition, the computer-implemented method includes matching those constituent segments unassociated with the (Continued)

known sources to remotely stored or recognized sounds in an event the present and prior conditions are similar.

5 Claims, 4 Drawing Sheets

(56) References Cited

U.S. PATENT DOCUMENTS

| | | | | |
|---|---|---|---|---|
| 2014/0100714 | A1 | 4/2014 | Linn et al. | |
| 2016/0035152 | A1 | 2/2016 | Kargupta | |
| 2017/0193714 | A1* | 7/2017 | Gonzales, Jr. ..... | G07C 5/0808 |
| 2018/0350167 | A1* | 12/2018 | Ekkizogloy ..... | G07C 5/0808 |

OTHER PUBLICATIONS

Laura Josefina De La Mora Molina et al., "Sound Analysis and Classification for Automobiles", U.S. Appl. No. 15/489,890, filed Apr. 18, 2017.

Radhakrishnan et al., "Audio Analysis for Surveillance Applications", 2005, IEEE Workshop on Applications of Signal Processing to Audio and Acoustics, 4 pages.

* cited by examiner

ANALYZING AND CLASSIFYING AUTOMOBILE SOUNDS

This application is a continuation of U.S. application Ser. No. 15/489,890, which was filed on Apr. 18, 2017. The entire disclosures of U.S. application Ser. No. 15/489,890 are incorporated herein by reference.

BACKGROUND

The present invention generally relates to automobiles and, more specifically, to a cognitive system and method that provides problem resolution by sound analysis and classification for automobiles.

There are many sources of noise in a vehicle. They include the engine, driveline, tire contact patch and road surface, brakes and the wind. Noise from cooling fans, or the heating ventilation and air conditioning (HVAC) system, alternator and other engine accessories is also fairly common. Many problems are generated as either vibration or noise, transmitted via a variety of paths, and then radiated acoustically into the cabin. These are classified as "structure-born" noises. Others are generated acoustically and propagated by airborne paths. Structure-born noises are attenuated by isolation, while airborne noise is reduced by absorption or through the use of barrier materials. Vibrations are sensed at the steering wheel, the seat, armrests or the floor and pedals. Some problems are sensed visually, such as the vibration of the rear-view mirror or header rail on open-topped cars.

SUMMARY

Embodiments of the present invention are directed to a computer-implemented method for analyzing and classifying automobile sounds. The computer-implemented method includes causing a receiver to receive an audio input, determining whether the audio input is distinct from sounds stored in a library and breaking the audio input up into constituent segments in an event the audio input is distinct from sounds stored in the library. The computer-implemented method further includes determining whether any of the constituent segments are unassociated with known sources and determining whether present conditions, which were in effect during the receiving of the audio input, are similar to prior conditions, which were in effect during a previous audio input reception, in an event constituent segments are unassociated with the known sources. In addition, the computer-implemented method includes matching those constituent segments unassociated with the known sources to remotely stored or recognized sounds in an event the present and prior conditions are similar.

Embodiments of the invention are directed to a computer program product for analyzing and classifying automobile sound. The computer program product includes a processor and a computer-readable medium having program instructions stored thereon, which, when executed, cause the processor to perform a method. The method includes causing a receiver to receive an audio input, determining whether the audio input is distinct from sounds stored in a library and breaking the audio input up into constituent segments in an event the audio input is distinct from sounds stored in the library. The method also includes determining whether any of the constituent segments are unassociated with known sources and determining whether present conditions, which were in effect during the receiving of the audio input, are similar to prior conditions, which were in effect during a previous audio input reception, in an event constituent segments are unassociated with the known sources. In addition, the method includes matching those constituent segments unassociated with the known sources to remotely stored or recognized sounds in an event the present and prior conditions are similar.

Embodiments of the invention are directed to an automobile. The automobile includes an audio input receptive receiver, a processor, and a computer-readable medium. The computer-readable medium has a library and program instructions stored thereon. When executed, the program instructions cause the processor to perform a method. The method includes causing the receiver to receive an audio input, determining whether the audio input is distinct from sounds stored in a library comprising the local database and breaking the audio input up into constituent segments in an event the audio input is distinct from sounds stored in the library. The method also includes determining whether any of the constituent segments are unassociated with known sources and determining whether present conditions, which were in effect during the receiving of the audio input, are similar to prior conditions, which were in effect during a previous audio input reception, in an event constituent segments are unassociated with the known sources. In addition, the method includes matching those constituent segments unassociated with the known sources to remotely stored or recognized sounds in an event the present and prior conditions are similar.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

Figure 1:
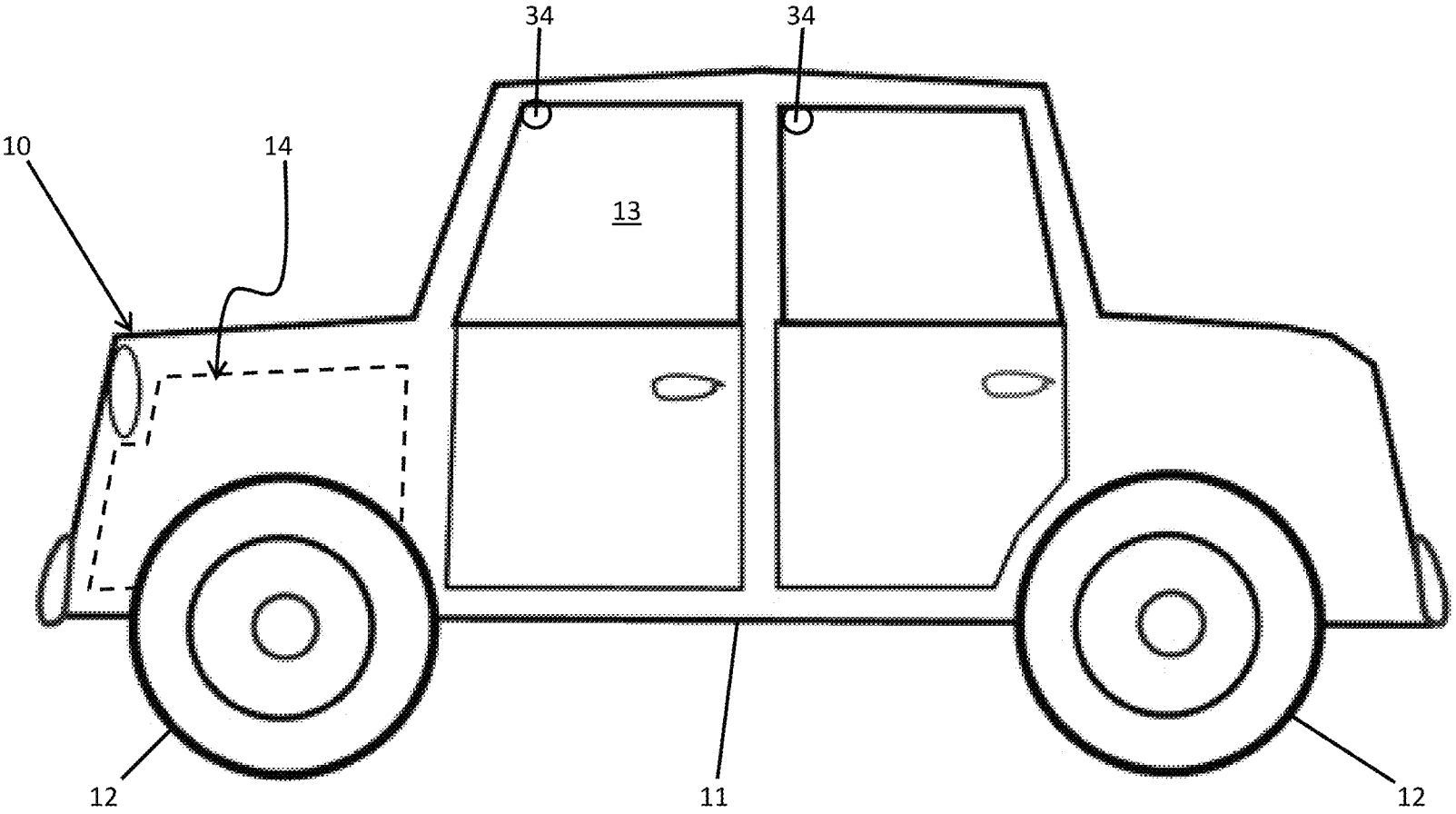
FIG. 1 is a side view of an automobile in accordance with embodiments of the present invention.

The diagrams depicted herein are illustrative. There can be many variations to the diagram or the operations described therein without departing from the spirit of the invention. For instance, the actions can be performed in a differing order or actions can be added, deleted or modified. Also, the term "coupled" and variations thereof describes having a communications path between two elements and does not imply a direct connection between the elements with no intervening elements/connections between them. All of these variations are considered a part of the specification.

In the accompanying figures and following detailed description of the disclosed embodiments, the various elements illustrated in the figures are provided with two or three digit reference numbers. With minor exceptions, the leftmost digit(s) of each reference number correspond to the figure in which its element is first illustrated.

DETAILED DESCRIPTION

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" may be understood to include any integer number greater than or equal to one, i.e. one, two, three, four, etc. The terms "a plurality" may be understood to include any integer number greater than or equal to two, i.e. two, three, four, five, etc. The term "connection" may include both an indirect "connection" and a direct "connection."

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

For the sake of brevity, conventional techniques related to making and using aspects of the invention may or may not be described in detail herein. In particular, various aspects of computing systems and specific computer programs to implement the various technical features described herein are well known. Accordingly, in the interest of brevity, many conventional implementation details are only mentioned briefly herein or are omitted entirely without providing the well-known system and/or process details.

Turning now to an overview of technologies specifically relevant to aspects of the invention, noises in a vehicle can be tonal in the case of engine noise or broadband in the case of road noise or wind noise. Some resonant systems respond at characteristic frequencies, but in response to random excitation. Therefore, although they look like tonal problems on any one spectrum, their amplitude varies considerably. Other problems are self-resonant, such as whistles from antennas. Tonal noises are often harmonic. Instruments that can be used to measure noises in a vehicle include microphones, accelerometers and force gauges or load cells. Nevertheless, there remains a need for complex diagnoses of unusual or "out-of-specification" sounds in an automobile that is based on analytics and classification of such sounds in order to yield performance predictions (e.g., of a given repair based on driving habits of the operator).

Turning now to an overview of the aspects of the invention, one or more embodiments of the invention address the above-described shortcomings of the prior art by providing for analysis and classification of sounds for an automobile so that certain problems that could be associated with certain sounds can be addressed and resolved in a timely manner. A cognitive method is defined that provides for problem resolution by sound analysis and classification as well as a machine learning process that arises from continuous updates made to a sound library following real-time sound capture classification as well as additional sound library updates from owner input, social forums and auto manufacturers and mechanics. The cognitive method also yields performance predictions of a given repair based on machine learning of the driving habits of each of the operators.

The above-described aspects of the invention address the shortcomings of the prior art by providing for an automobile that includes an audio input receptive receiver, a processor and a computer-readable medium. The computer-readable medium has a local database and program instructions stored thereon. When executed, the program instructions cause the processor to perform a method. The method includes causing the receiver to receive an audio input, determining whether the audio input is distinct from sounds stored in a library that includes the local database and breaking the audio input up into constituent segments in an event the audio input is distinct from sounds stored in the library. The method further includes determining whether any of the constituent segments are unassociated with known sources and determining whether present conditions, which were in effect during the receiving of the audio input, are similar to prior conditions, which were in effect during a previous audio input reception, in an event constituent segments are unassociated with the known sources. In addition, the method includes matching those constituent segments unassociated with the known sources to remotely stored or recognized sounds in an event the present and prior conditions are similar.

Turning now to a more detailed description of aspects of the present invention, with reference to FIG. 1, an automobile 10 is provided. The automobile 10 can be configured as a passenger car or a truck and, in any case, includes a chassis 11, wheels 12 attached to the chassis 11, a cabin 13 and an engine 14. The engine 14 generates torque by which the wheels 12 are rotated to drive the automobile 10 forward or backward. The cabin 13 sits on the chassis 11 and accommodates an operator or driver, one or more passengers and various controls and displays to allow the driver to safely operate the automobile 10.

Figure 2:
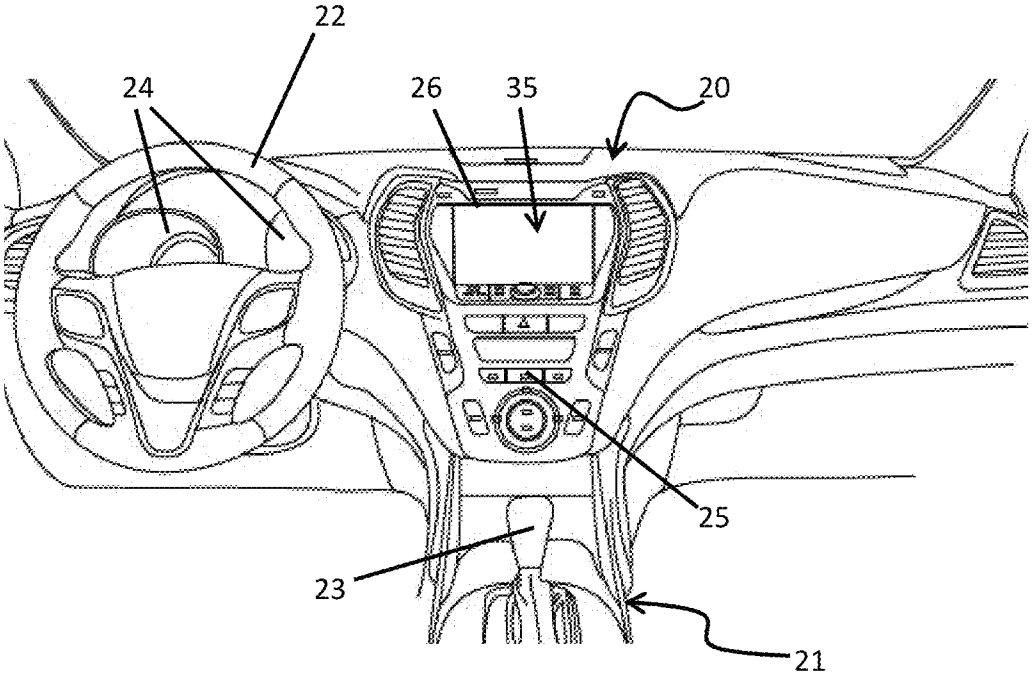
FIG. 2 is an illustration of a dashboard of the automobile of FIG. 1.

With reference to FIG. 2, the various controls and displays of the automobile 10 are housed in a dashboard 20 as well as a center console 21, the car doors and the ceiling of the cabin 13. As shown in FIG. 2, the various control controls and displays include a steering wheel 22, a gear shift 23, analog speed and RPM dials 24, climate controls 25 and a display unit 26. The display unit 26 may be configured for displaying a user interactive navigation system as well as other user interactive menus and controls.

Figure 3:
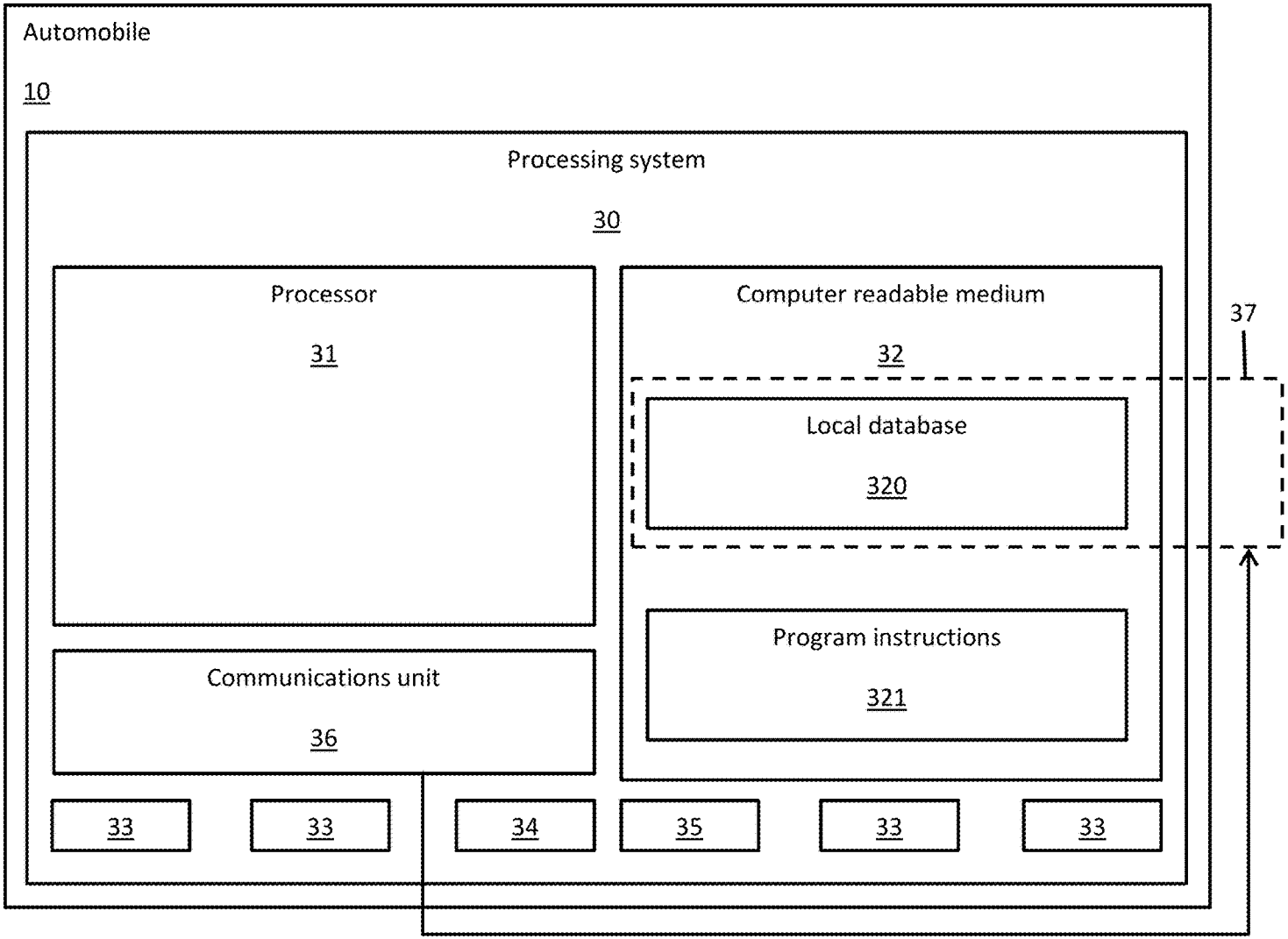
FIG. 3 is a schematic diagram illustrating components of a computer program product for analyzing and classifying automobile sound for use with the automobile of FIGS. 1 and 2.

With reference to FIG. 3, the automobile 10 further includes a processing system 30. As shown in FIG. 3, the processing system 30 includes a processor 31, such as a central processing unit (CPU), a computer readable medium 32, such as a hard disk drive and other memory or storage units, various sensors 33 that are distributed around the automobile 10, an audio input receptive receiver 34 (see FIG. 1) and an output device 35 (see FIG. 2). The computer readable medium 32 can include a local database 320 and program instructions 321 which are executable by the processor 31. The various sensors 33 are configured to sense multiple conditions of the automobile 10 during operational conditions. These include tire pressures, vibrations, skidding, etc. The audio input receptive receiver 34 can be provided as one or more microphones that are distributed throughout the cabin 13 and can be configured to pick up and receive sounds that are both expected and unexpected in the cabin 13. Such sounds can be recorded in the local database along with additional information that is pertinent to the sounds being recorded. The output device 35 can be provided as the display unit 26 and/or as a speaker which is disposed in the cabin 13.

The automobile 10 can further include a communications unit 36. The communications unit 36 is coupled to the processor 31 and the computer readable medium 32 and provides for communications between the processor 31 and memory or storage remote from the automobile 10 (e.g., the cloud). Such memory or storage remote from the automobile 10 and the local database 320 can be provided as components of a library 37 of sounds and other related information.

Figure 4:
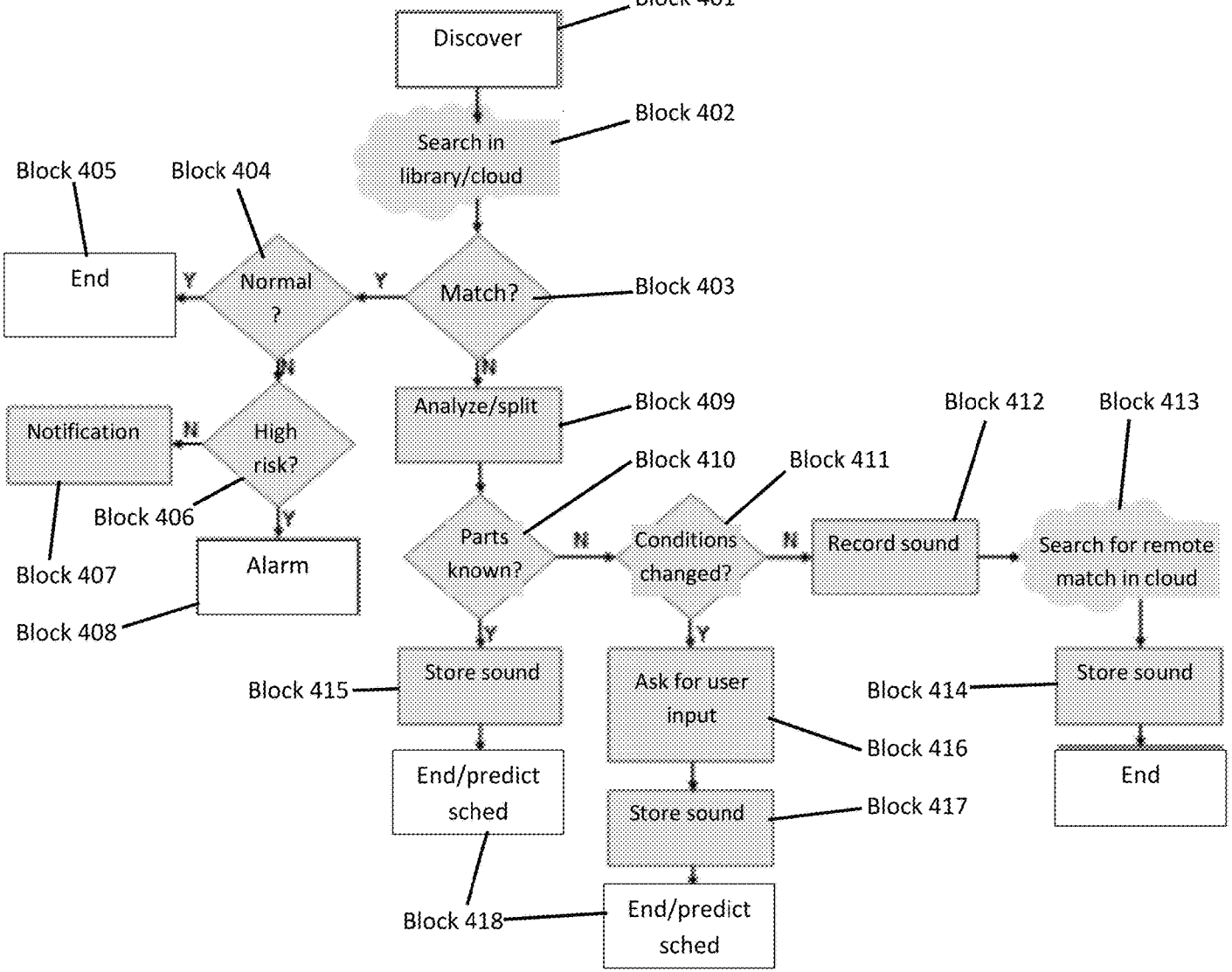
FIG. 4 is a flow diagram illustrating a method of analyzing and classifying automobile sound.

With reference to FIG. 4, when executed, the program instructions 321 cause the processor 31 to perform a method. As shown in FIG. 4, the method includes causing the audio input receptive receiver 34 to receive an audio input (block 401) and to subsequently search for matching audio inputs in the library 37 in general and the local database 320 in particular (block 402) to determine whether the audio input is distinct from sounds stored in the library 37 and the local database 320 (block 403).

In an event the audio input is determined at block 403 to be indistinct from or matched with sounds stored in the library 37 or the local database 320, information associated with or otherwise related to the stored sounds is queried (see, e.g., the additional information stored with the sounds in the local database 320 of FIG. 3) to determine if the sounds matched by the audio input are normal sounds generated during standard operations of the automobile (block 404). In an event the sounds matched by the audio input are normal, the method ends (block 405). In an event the sounds matched by the audio input are not normal, the information associated with or otherwise related to the stored sounds is queried again to determine if the sounds matched by the audio input are indicative of a high risk event (block 406). In an event the sounds matched by the audio input are not indicative of the high risk event, a notification is issued (block 407) and, in an event the sounds matched by the audio input are indicative of the high risk event, an alarm is issued (block 408).

In accordance with embodiments, the notification and the alarm can both be issued by the output device 35, which, in these cases, acts as a notification and alert output device. In addition, the notification and the alarm can both be configured to include playable recordings of the relevant sounds, descriptions of the relevant sounds, and displayable information which describes the relevant sounds as well as their probable or associated causes. In this way, the sounds can be replayed for an automobile mechanic or service personnel and their recommendations for repairs can either be reliant on the information or cross-checked with the information for verification.

Returning to FIG. 4, in an event the audio input is determined to be distinct from sounds stored in the library 37 or the local database 320 at block 403, the audio input is broken up into its constituent segments (block 409) by appropriate audio analysis hardware 310 and software 311 that is included in the processor 31 (see FIG. 3). Thus, a given audio input may be broken up into multiple audio input segments that include a first sound S1 having a first cause/source C/S 1, a second sound S2 having a second cause/source C/S 2, etc. At this point, the method further includes determining whether any of the constituent segments are unassociated with known sources (block 410) and then determining whether present conditions, which were in effect during the receiving of the audio input, are similar to prior conditions, which were in effect during a previous audio input reception, in an event constituent segments are determined to be unassociated with the known sources (block 411).

In accordance with embodiments, the determining of whether any of the constituent segments are unassociated with known sources of block 410 can be executed in a similar manner as the determinations of block 403. That is, the method can include determining whether any of the constituent segments match sounds stored in the library 37 or the local database 320 and, if so, further determining whether any of the constituent segments matching stored sounds are associated with normal operations or high risk events.

In an event it is determined that the present conditions have not changed from the prior conditions, the method further includes recording the constituent segments which are found to be unassociated with the known sources in block 410 (block 412), matching those constituent segments to remotely stored or recognized sounds (block 413) and storing the constituent segments in the local database 320 along with information relating to the constituent segments (block 414). The matching of the constituent segments with the remotely stored or recognized sounds can be executed, for example, by searching for sounds corresponding to the constituent segments in the cloud or another similar memory or storage unit or by playing the constituent segment for an automobile mechanic or service person that could potentially recognize it.

In accordance with further embodiments and, as shown in FIG. 4, in an event constituent segments are determined to be associated with the known sources in block 410, the method further includes recording and storing those constituent segments associated with the known sources in the local database 320 along with the information relating thereto (block 415). Similarly, in an event the present and prior conditions are determined to be dissimilar in block 411, the method further includes causing the output device 35, which, in this case, acts as an interface device, to request a user input regarding the conditions (block 416) and then recording and storing those constituent segments unassociated with the known sources in the local database 320 (block 417).

In accordance with further embodiments and, as shown in FIG. 4, the method can further include predicting a maintenance schedule for the automobile 10 based on the constituent segments being associated with the known sources or matching the remotely stored or recognized sounds (block 418). In doing so, the processor 31 can take into account various additional factors including, but not limited to, the driving habits of the various drivers of the automobile 10 and whether the automobile 10 is generally driven in the city, the suburbs or the country.

In accordance with still further embodiments, the methods described herein with respect to block 418 in particular can be employed to assist an individual with a selection of a best option for a next automobile purchase. Such assistance could be based on the individual's driving habits which are discerned from historical data and from the sounds recorded and analyzed throughout the lifetime of his/her present automobile ownership. For example, if the individual presently owns an automobile with a manual transmission but is not capable of performing well timed or efficient gear shifting to the point that the recorded sounds include high revving sounds and those of a worn out transmission, the method may include recommending an automobile with an automatic transmission as a next purchase.

Another additional feature may include financial optimization-based repair prediction as part of the operations of block 418. Here, driving habits and associated sounds are used as inputs. For example, city driving with be associated with certain recorded sounds such as high frequency stopping and starting whereas highway driving will tend to be associated with more constant sounds. Thus, in the case of brakes becoming worn out, a predominance of recorded sounds which suggest mostly city driving will result in a much earlier recommendation for brake service as compared to a predominance of highway driving (e.g., 500 miles versus 3000 miles).

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instruction by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A computer-implemented method for analyzing and classifying automobile sounds, the computer-implemented method comprising:

causing a receiver to receive an audio input;

determining, at a processor, whether the audio input is distinct from sounds stored in a library;

breaking the audio input up into constituent segments in an event the audio input is distinct from sounds stored in the library;

determining, at a processor, whether any of the constituent segments are unassociated with known sources;

determining, at a processor, whether present conditions, which were in effect during the receiving of the audio input, are the same as prior conditions, which were in effect during a previous audio input reception, in an event constituent segments are unassociated with the known sources; and matching those constituent segments unassociated with the known sources to remotely or cloud stored or recognized sounds in an event the present and prior conditions are the same, wherein:

in an event the present and prior conditions are not the same, the method further comprises causing an interface device to request a user input and recording and storing those constituent segments unassociated with the known sources in the library, and in an event the present and prior conditions are the same, the method further comprises recording and storing the constituent segments unassociated with the known sources in the library.

2. The computer-implemented method according to claim 1, further comprising:

causing an output device to issue a notification in an event the audio input is indistinct from sounds stored in the library which are not associated with a high risk; and causing the output device to issue an alarm in an event the audio input is indistinct from sounds stored in the library which are associated with a high risk.

3. The computer-implemented method according to claim 1, wherein, in an event constituent segments are associated with the known sources, the method further comprises recording and storing those constituent segments associated with the known sources in the library.

4. The computer-implemented method according to claim 1, wherein the matching of the constituent segments unassociated with the known sources comprises:

searching for matching sounds in remote or cloud databases; and recording and storing the constituent segments associated with the known sources in the library.

5. The computer-implemented method according to claim 1, further comprising predicting a maintenance schedule and generating a purchase or repair recommendation based on the sounds stored in the library.

* * * * *